United States Patent [19]

Cunningham

[11] 4,274,928

[45] Jun. 23, 1981

[54] PROCESS FOR ELECTROLYZING BRINE IN A PERMIONIC MEMBRANE ELECTROLYTIC CELL

[75] Inventor: Hugh Cunningham, Corpus Christi, Tex.

[73] Assignee: PPG Industries, Inc., Pittsburgh, Pa.

[21] Appl. No.: 62,211

[22] Filed: Jul. 30, 1979

Related U.S. Application Data

[62] Division of Ser. No. 928,645, Jul. 27, 1978.

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 1,269,128 | 6/1918 | Stuart | 204/286 |
| 1,302,824 | 5/1919 | Marsh | 204/266 |
| 1,879,842 | 9/1932 | Conradty | 204/252 |
| 3,102,085 | 8/1963 | Edwards et al. | 204/128 |
| 3,989,615 | 11/1976 | Kiga et al. | 204/252 |
| 4,013,525 | 3/1977 | Emsley | 204/98 |
| 4,073,715 | 2/1978 | DeNora | 204/283 |
| 4,100,050 | 7/1978 | Cook et al. | 204/98 |

FOREIGN PATENT DOCUMENTS

| | | | |
|---|---|---|---|
| 1435477 | 5/1976 | United Kingdom | 204/252 |
| 1448904 | 9/1976 | United Kingdom | 204/252 |

OTHER PUBLICATIONS

U.S. application Ser. No. 439,058, filed 2-4-74.

*Primary Examiner*—R. L. Andrews
*Attorney, Agent, or Firm*—Richard M. Goldman

[57] ABSTRACT

Disclosed is an electrolytic cell having an anode unit, a cathode unit substantially parallel to and spaced from the anode unit with individual cathodic elements therein, and a permionic membrane interposed between the cathodic unit and the anodic unit. The individual cathodic elements are elongate elements substantially perpendicular to the anode unit. Also disclosed is an electrolytic cell comprising a plurality of cathode units electrically in parallel, a plurality of anode units electrically in parallel and interleaved between the cathode units so that a cathode unit is interleaved between a pair of adjacent anode units and an anode unit is interleaved between a pair of adjacent cathode units. The electrolytic cell also has a plurality of permionic membranes, each permionic membrane interposed between a cathode unit and an anode unit.

4 Claims, 7 Drawing Figures

PROCESS FOR ELECTROLYZING BRINE IN A PERMIONIC MEMBRANE ELECTROLYTIC CELL

This is a division of application Ser. No. 928,645, filed July 27, 1978.

DESCRIPTION OF THE INVENTION

Chlorine and alkali metal hydroxides, e.g., caustic soda and caustic potash, are commercially prepared by several alternative electrolytic processes including electrolysis in a permionic membrane cell. In the permionic membrane cell process, alkali metal chloride brine is fed to the anolyte compartment of a multi-compartment electrolytic cell and chlorine gas and depleted brine are recovered therefrom. Alkali metal ions permeate through the permionic membrane barrier to the catholyte compartment where alkali metal hydroxide and hydrogen are recovered as products. Additionally, water may be added to the catholyte compartment.

It has been found, see for example British Pat. No. 1,435,477 to Hooker Chemicals and Plastics Corp. for Electrolytic Cell and Process, British Pat. No. 1,448,904 to Hooker Chemicals and Plastics Corp. for Electrolytic Cell and Process, and Belgian Pat. No. 75/01249 to Staley et al. for membrane Cell Operation, that in a permionic membrane electrolytic cell, particularly satisfactory results are obtained if the permionic membrane is spaced from the cathode rather than bearing upon the cathode as is conventionally done with deposited asbestos diaphragms.

Additionally, it has now been found that when the permionic membrane is spaced from the cathode, e.g., closer to the anode than the cathode, and even bearing upon the anode, cathode configurations may then be utilized which provide a cathode area greater than the area of the anodic elements.

THE FIGURES

The permionic membrane electrolytic cell of this invention is shown in the following figures.

DETAILED DESCRIPTION OF THE INVENTION

Figure 1:
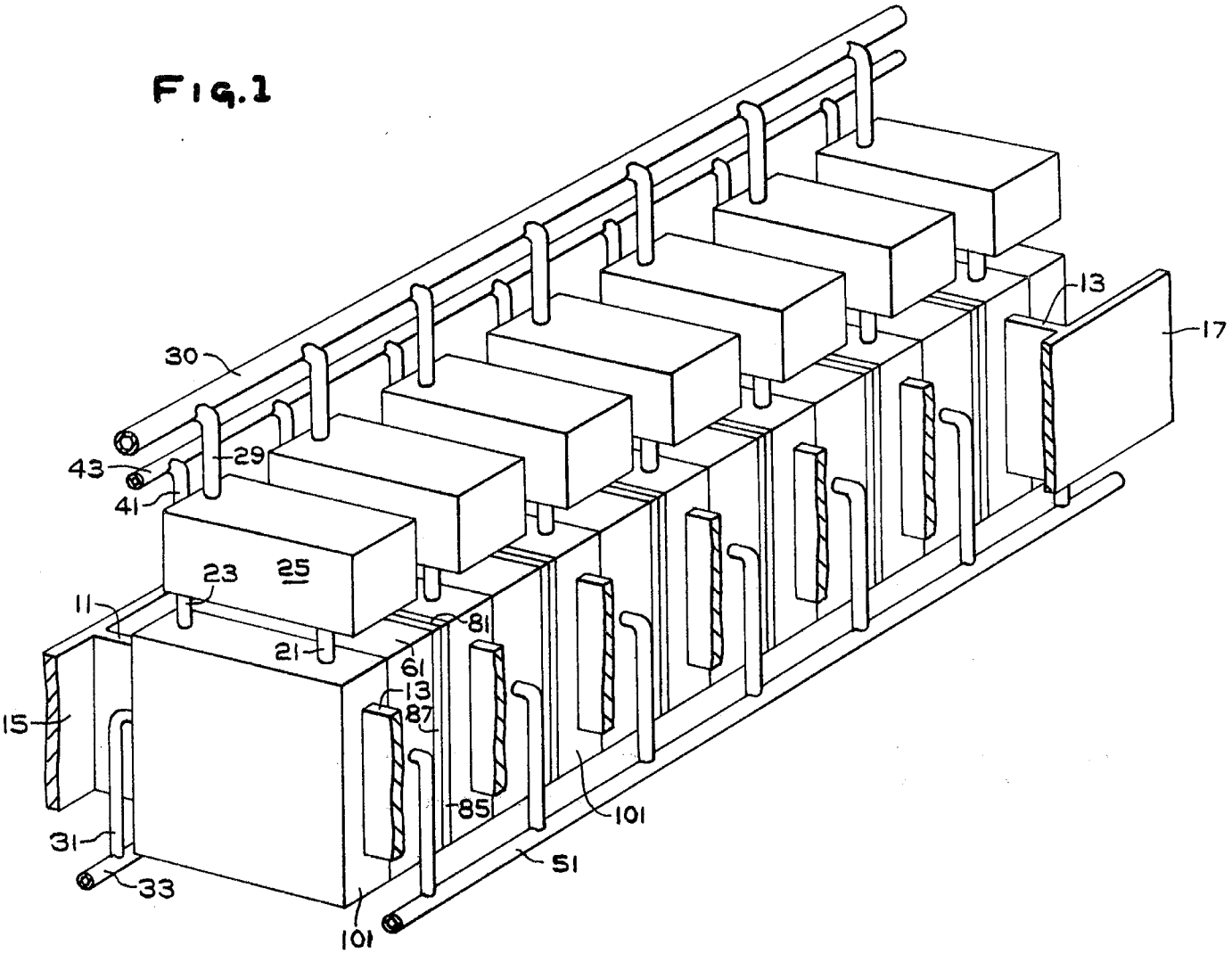
FIG. 1 is an isometric view of an electrolytic cell of this invention.
Figure 2:
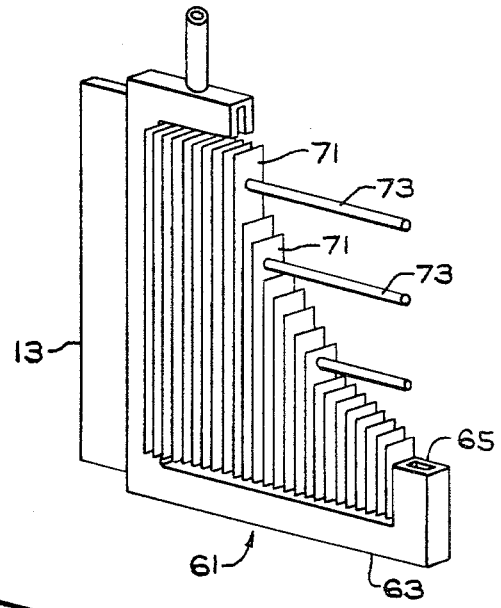
FIG. 2 is a cathode unit of an electrolytic cell of this invention.
Figure 3:
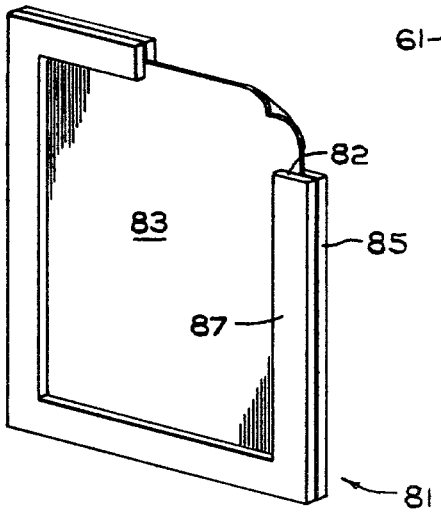
FIG. 3 is a permionic membrane unit of an electrolytic cell of this invention.
Figure 4:
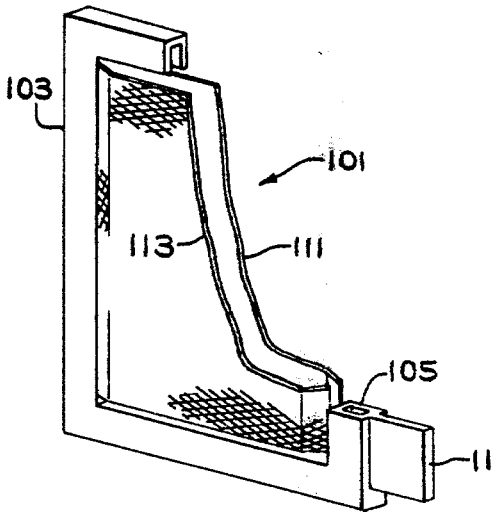
FIG. 4 is an anode unit of an electrolytic cell of this invention.
Figure 5:
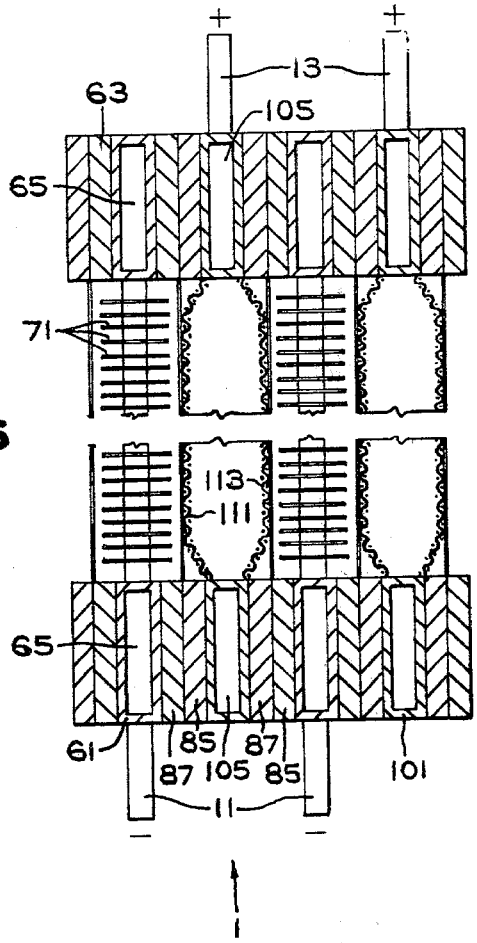
FIG. 5 is a partial cutaway plan view of an electrolytic cell of this invention.
Figure 6:
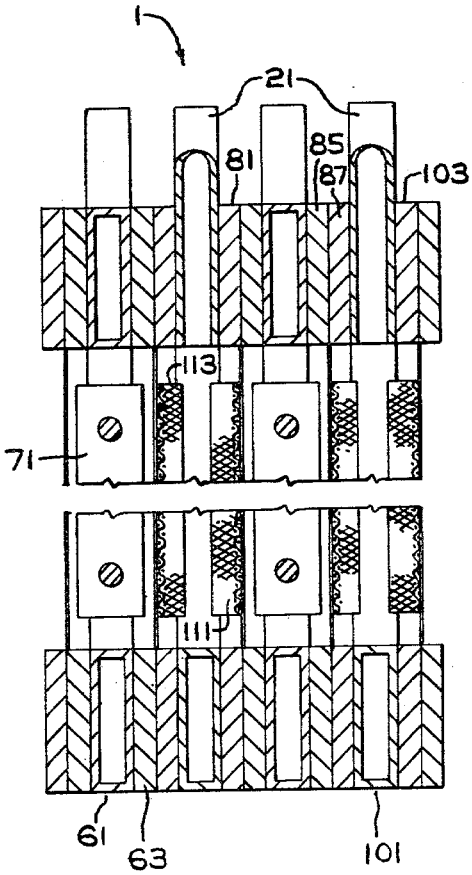
FIG. 6 is a partial cutaway side elevation of an electrolytic cell of this invention.

The electrolytic cell 1 of this invention has the configuration of a plurality of cathode units 61 interposed between a plurality of anode units 101 whereby a cathode unit 61 is interleaved between a pair of adjacent anode units 101 and an anode unit 101 is interleaved between a pair of adjacent cathode units 61. The electrolytic cell 1 also includes a plurality of permionic membrane units 81 with each permionic membrane unit

81 interposed between an anode unit 101 and a cathode unit 61.

The cathode units 61 are electrically in parallel with each other through cathodic bus bar leads 11 to bus bars 15. The anodic units 101 are electrically in parallel with each other through anodic bus bar leads 13 to bus bars 17.

The permionic membrane 83 of the permionic membrane units 81 is closer to the anodic elements 111 than to the cathodic elements 71. Preferably, the membrane 83 is maintained in contact with, that is, against, the anodic element 111 and may even bear upon or supported by the anodic element 111.

The electrolytic cell structure herein described allows the position of the permionic membrane 81 relative to the anode 111, 113 and cathode 71 positions to be independent of the anolyte liquor head and catholyte liquor head. According to a preferred exemplification of the invention herein contemplated, the permionic membrane 81 is nearer the anode 111, 113 than the cathode 71, e.g., the permionic membrane 81 rests upon the anode 111, 113 while the anolyte liquor head is equal to or greater than the catholyte liquor head. According to one particularly preferred exemplification, the membrane 81 rests upon the anode 111, 113 while the anolyte liquor is at a higher level than the catholyte liquor.

According to an alternative exemplification, a substantially non-reactive, non-conductive spacing element, such as a fluorocarbon mesh, fluorocarbon screen, fluorocarbon spacer rods, or the like, may be interposed between the anodic elements 111 and the membrane 83 in order to provide a space therebetween.

On the anodic side of an individual cell, concentrated brine is fed to the cell 1 where electrolysis occurs with chlorine being evolved at the anodes, and alkali metal ion passing through the permionic membrane 83 to cathode compartments 61. Depleted brine is recovered from the anolyte compartment.

The concentrated brine feed is fed from the header 27 to the brine box 25 where it mixes with the froth of chlorine and brine from the cell 1, entering the brine box 25 through brine line 21 from cell 1. The brine and chlorine gas are separated and the brine in the brine box 25 returns to the cell 1 through a return line, for example, return line 23. In this way, a circulatory motion is set up with brine going from the brine box 25 to the cell 1, chlorine gas-brine froth going from the cell 1 to the brine box 25, the chlorine being separated from the brine in the brine box and the chlorine going through the chlorine line 29 to the chlorine header. New brine is added to the brine box 25 from brine header 27 and chlorine circulation continues.

Dilute brine is recovered from the cell 1 through depleted brine outlet 31 and carried by depleted brine header 33 to resaturation unit for resaturation, for example, with solid salt.

On the cathodic side of the cell 1, alkali metal ion permeates through the permionic membrane 83 from the anolyte compartment 111 to the catholyte compartment 61 with hydrogen being evolved at the cathode 71 and removed through the hydrogen line 41 to the hydrogen header 43. Catholyte liquor is withdrawn through an outlet 49 to the catholyte liquor header 51. Water can be added to the catholyte liquor from water header 47 through water line 49.

The electrical circuit of the electrolytic cell is from the anode bus bar 17 through the anode bus bar lead 11 to the anode unit 105 through electrolyte to the cathode 71 and is out through the cathode 65 to the cathode bus bar lead 11 to the cathode bus bars 13.

The cathodic unit 61 has a structural member in a picture frame form with peripheral walls 63 having internal conduits 65 for catholyte liquor. The structural member has means for caustic recovery, water feed, and hydrogen recovery. Materials of construction of the cathode unit 61 may be iron, steel, stainless steel, or a polymeric material. Useful polymeric materials include the halocarbons as exemplified by the fluorocarbons.

Within the cathodic unit 61 are internal conductor means 73 from the bus bar to the cathodic elements 71. This internal conductor means 73 is normally perpendicular to the cathode elements 71. The materials of construction of the internal conductor means may be iron, steel, stainless steel, copper, or aluminum. The internal conductor means 73 are generally in the form of rods, tubes, or bars.

The cathodic elements 71 are parallel, elongate individual electrode elements in the shape of blades, fingers, or rods.

The cathode elements 71 may be vertically or horizontally disposed. A vertical array is preferred in order to avoid gas blinding. The individual cathode element 71 may be perpendicular to the anode to allow higher cathode area such that the current density on the cathode is lower than the current density on the anode.

When the individual cathode elements 71 are fins or blades they may be inclined with respect to the plane of the membrane. In a preferred exemplification, they are perpendicular to the plane of the membrane.

The individual cathode elements 71 may be constructed of iron, steel, stainless steel, or copper. They may be coated with various hydrogen evolution catalysts or coated on various portions of the surface with both hydrophilic and hydrophobic materials.

The area of the cathodic elements 71 is greater than the area of the anodic elements 111 whereby to provide for a higher anode current density than cathode current density.

The anodic unit 101 has a frame 103 which includes a conduit 105 communicating with means for product removal and brine feed. The means include brine feed inlet 27, chlorine outlet 29, and dilute brine removal lead 31. The anodic electrode, i.e., the anodic element, is in the form of two sheets 111, 113. The sheets 111, 113 may be flat sheets substantially parallel to the permionic membrane 83 or they may have some degree of bevelling at the edge.

The anodic elements 111 are perforate, foraminous, mesh, perforated plates, expanded metal mesh sheets, screens, rods, or the like. For best results they are inwardly and upwardly louvered in order to draw gas away from the inner electrode gap.

Electrical conduction elements 115 extend from the anode units 101 through the walls of the anodic element 101 to the anodic bus bar lead 13.

The permionic membrane unit 81 includes walls 82 in the form of a picture frame and gasketing 85, 87. The gasketing 85, 87 serves to space the membrane from the cathodic elements 71, substantially parallel to, and either spaced from or bearing upon the anodic elements 111. Preferably the permionic membrane 83 is closer to the anodic elements 111 than to the cathodic elements 71.

The permionic membrane 81 is substantially impermeable to the bulk flow of electrolyte and to the flow of anions such as chlorine but is permeable to the flow of cations such as potassium ion or sodium ion as applicable.

The preferred permionic membrane materials are halocarbon polymers having pendant acid groups especially preferred as highly fluorinated polymers having pendant acid groups as sufonyl groups, sulfonamide groups, carboxylic groups, and derivatives thereof. Such permionic membrane materials include copolymers of either tetrafluoroethylene or hexafluoroethylene with fluorinated vinyl unsaturated moieties having pendant acid groups.

Figure 7:
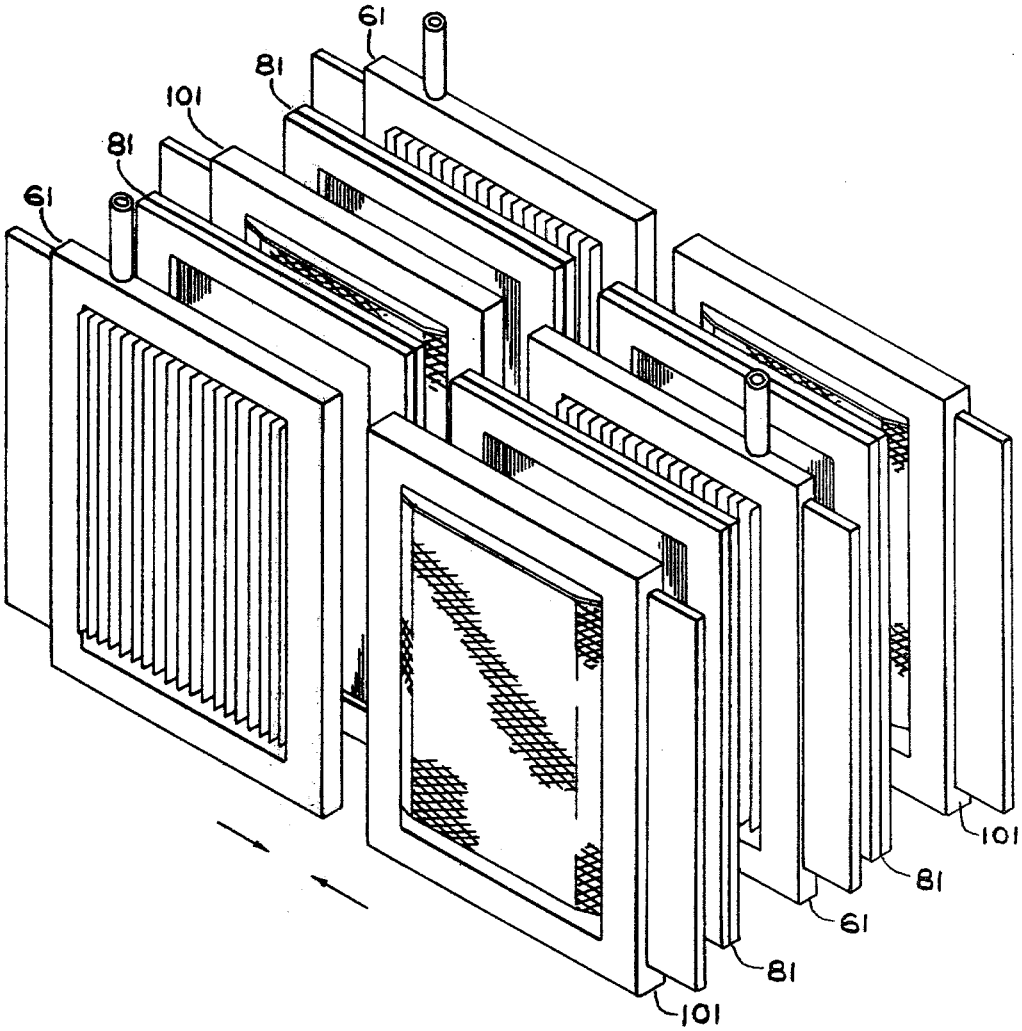
FIG. 7 is an isometric, exploded view of a bipolar electrolyzer utilizing the cathode element herein contemplated.

While the figures illustrate the cell structure in a monopolar electrolytic cell having bus bars 15 and 17 between adjacent electrolytic cells 1 in an electrolytic cell circuit, the cell structure of this invention may also be utilized in a bipolar electrolyzer as shown in FIG. 7. In a bipolar electrolyzer, the cathodic bus bar leads 11 are eliminated and the cathodic units 61 are joined directly to the corresponding anodic units 101 of the subsequent bipolar unit of the electrolyzer while the anodic bus bar leads 13 are eliminated and the anodic units 101 are joined directly to the corresponding cathodic units 61 of the prior bipolar unit of the electrolyzer. The individual electrode units may be permanently joined to the corresponding electrode unit of the adjacent cell as described above. Alternatively, the electrode units may be joined to the electrode units of adjacent cells, e.g., as by compressive fittings.

While the invention has been described with respect to certain exemplifications and embodiments thereof, the invention is not to be limited except as in the claims appended hereto.

I claim:

1. A method of conducting electrolysis in an electrolytic cell having an aqueous acidic anolyte in contact with anode means, an aqueous alkaline catholyte in contact with cathode means, said anolyte being separated from said catholyte by a permionic membrane, (a) said cathode means comprising a cathode unit having:
  (1) a picture frame of four peripheral walls;
  (2) internal conduit means within said peripheral walls;
  (3) a plurality of parallel, elongate, vertical cathodic elements; and
(b) said anode means comprising an anode unit substantially parallel to said cathode unit, and having a picture frame of four peripheral walls having internal conduit means, anodic elements within said picture frame, and bus bar means to said peripheral walls; and
(c) a spacing element interposed between the cathodic elements and the membrane whereby the permionic membrane is nearer the anodic elements than the cathodic elements;

which method comprises feeding brine to the anolyte, passing an electrical current from the anode means to the cathode means, and recovering chlorine and alkali metal hydroxide.

2. The method of claim 1 wherein the cathodic elements are substantially perpendicular to the anodic elements.

3. The method of claim 1 wherein the cathode elements have a greater surface area than the anode elements.

4. The method of claim 1 wherein said cathodic elements are rod elements.

* * * * *